US006130652A

United States Patent [19]

Goetz et al.

[11] Patent Number: 6,130,652

[45] Date of Patent: Oct. 10, 2000

[54] WIDEBAND, DUAL RHCP, LHCP SINGLE APERTURE DIRECTION FINDING ANTENNA SYSTEM

[75] Inventors: Allan C. Goetz, La Jolla; Robert G. Riddle, II, San Diego, both of Calif.

[73] Assignee: TRW Inc., Redondo Beach, Calif.

[21] Appl. No.: 09/333,760

[22] Filed: Jun. 15, 1999

[51] Int. Cl.[7] ..... H01Q 1/36

[52] U.S. Cl. ..... 343/895; 343/853

[58] Field of Search ..... 343/895, 853, 343/789, 850, 860, 864; H01Q 1/36

[56] References Cited

U.S. PATENT DOCUMENTS

| | | | |
|---|---|---|---|
| 3,681,772 | 8/1972 | Ingerson | 343/895 |
| 4,630,064 | 12/1986 | Andrews et al. | 343/895 |
| 4,658,262 | 4/1987 | DuHamel | 343/895 |
| 5,162,806 | 11/1992 | Monser | 343/895 |
| 5,777,579 | 7/1998 | Goetz et al. | 342/373 |

*Primary Examiner*—Hoanganh Le
*Attorney, Agent, or Firm*—Michael S. Yatsko

[57] ABSTRACT

A wide band, single aperture antenna system (70) that provides simultaneous detection of both RHCP and LHCP signals. The antenna system (70) includes a multiple arm spiral antenna (10) that has spiral arm elements (12, 14, 16, 18) with no sharp transitions. To simultaneously both RHCP and LHCP sensitivity, an antenna feed is connected to both the center end and the outer end of each of the antenna arm elements (12, 14, 16, 18). A separate N-port transformer (74, 78) is connected to both the end feed and the center feed for all of the arms (12, 14, 16, 18) to provide impedance matching and cross-polarization compensation. An NXN port modeformer (76, 80) is connected to the N-port transformers (74, 78) to separate the various modes. The modeformers (76,80) separate the LHCP and RHCP modes to provide an accurate AoA estimation.

20 Claims, 2 Drawing Sheets

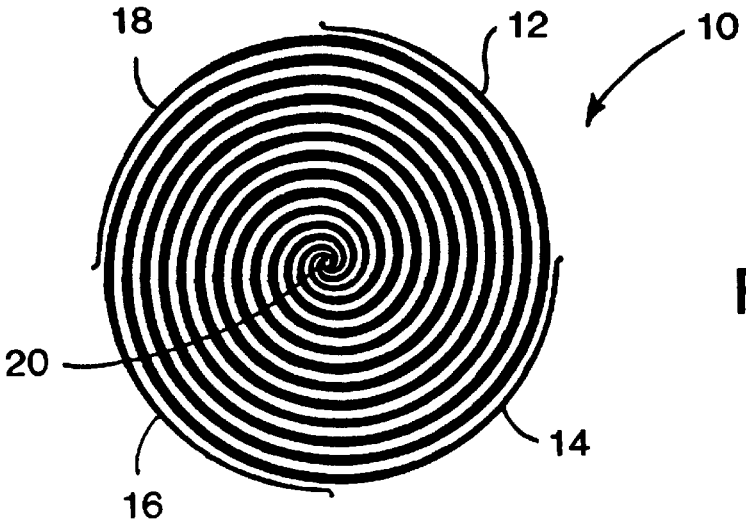
FIG. 1
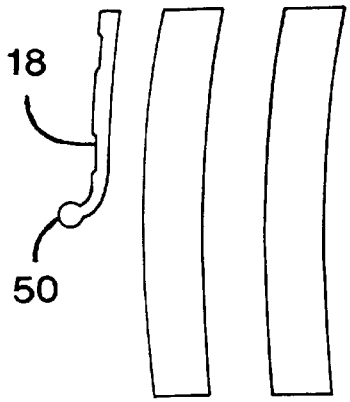
FIG. 3
FIG. 2
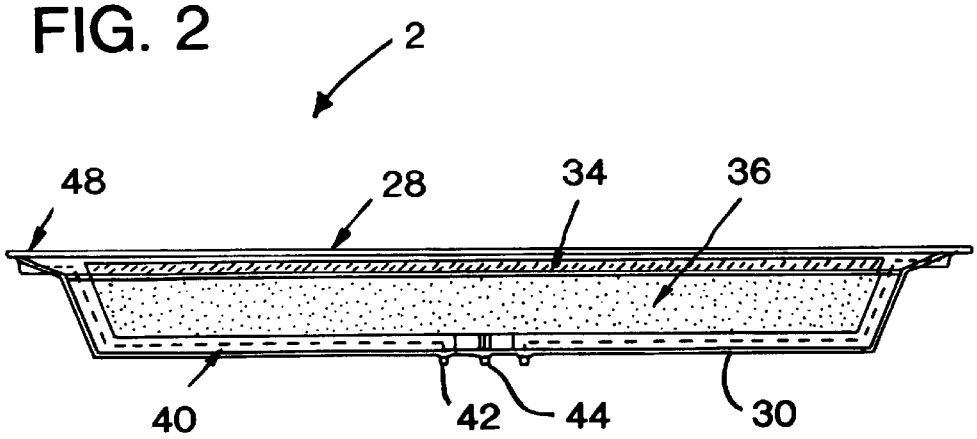

WIDEBAND, DUAL RHCP, LHCP SINGLE APERTURE DIRECTION FINDING ANTENNA SYSTEM

BACKGROUND OF THE INVENTION

1. Field of the Invention

This invention relates generally to a spiral arm antenna and, more particularly, to a wideband, multi-mode, center-fed/end-fed, spiral arm antenna that simultaneously senses both right-hand circularly polarized and left-hand circularly polarized signals.

2. Discussion of the Related Art

Tactical military aircraft operating in a warfare scenario typically radar and communications signals. These signals may be low frequency UHF and VHF signals, radar frequency signals, or high frequency signals (0.3–18 GHz). These signals may be cross-polarized signals that are either right-hand circularly polarized (RHCP) or left-hand circularly polarized (LHCP) or a combination of the two. The sense of the polarization defines the rotation of the signal as it propagates.

Aircraft are generally equipped with signal sensing systems that sense the radar and communications signals, and then determine angle of arrival (AoA) and calculate the direction of the signals. This allows the pilot of the aircraft to take evasive or other actions. To be effective in modern warfare, these sensing systems must employ an antenna system that is able to simultaneously detect both RHCP and LHCP signals in the frequency band of interest.

Multiple arm spiral antennas are known in the art for their ability to sense RHCP and LHCP signals. The known multiple arm spiral antenna systems typically include a plurality of spiral antenna arms spiraling out from a common central location. The antenna feed for each separate arm is generally connected to the end of the arm at the common central location. U.S. Pat. No. 3,681,772 discloses a spiral antenna that includes multiple spiral arms radiating out from a common center, where the arms are connected to the antenna feed only at the central location. Patent, '772 generates the counter rotating modes by reflecting currents from impedance discontinuities in the arms. This spiral antenna is sensitive to both RHCP and LHCP signals. Additionally, U.S. Pat. No. 4,658,262 also discloses a dual polarized sinuous antenna that includes a plurality of spiral antenna elements extending from a common central location. The sinuous antenna disclosed in this patent is also only fed at this common central location of the arms.

Modern military aircraft are low-observable aircraft that have small radar signatures. To maintain this low-observability, any antenna system mounted on the aircraft must conform with the aircraft structure and not increase its radar cross-section (RCS). The conductive material in the antenna, however, adds to the RCS. Sharp edges of the antenna elements also provide a significant increase in the RCS at certain frequencies. Both of the spiral arm antennas disclosed in the '772 and '262 patents have significant RCS because the arm elements include sharp edges and transitions that add to the radar visibility. These transitions of the arm elements in the '772 and '262 patents are important to allow the antenna to sense both RHCP and LHCP signals when only being fed at the ends of the arms radiating from the antenna center.

Additionally, the antenna system for providing AoA estimations should detect higher order RHCP and LHCP modes to provide a higher relative phase rate to reduce the ambiguities of the AoA estimations, and make it more accurate. The more arms that are available, the more modes generated. Because higher order modes provide greater AoA accuracy, it is desirable to provide more modes without providing more arms so as to not increase the RCS. Less arms also decreases system fabrication costs and antenna system hardware.

What is needed is a multi-mode spiral arm antenna that simultaneously provides both RHCP and LHCP sensitivity, and provides higher order mode generation for increased AoA accuracy and a smaller RCS. It is therefore an object of the present invention to provide such an antenna.

SUMMARY OF THE INVENTION

In accordance with the teachings of the present invention, a wideband, single aperture antenna system is disclosed that provides simultaneous detection of both RHCP and LHCP signals. The antenna system includes a multiple spiral arm antenna that has smooth spiral arm elements with no sharp transitions. To simultaneously provide both RHCP and LHCP sensitivity, an antenna feed is connected to both the center end and the outer end of each of the antenna arm elements. Impedance matching is provided between the antenna arm elements and the feed circuitry for both the center feeds and the end feeds. The impedance matching can be provided by any suitable impedance transformer, such as stripline transformers, micro-strip transformers, and co-axial cables. The feed circuitry includes an NXN port modeformer for both the center-feed and end-feed to separate the various modes for both the LHCP and RHCP signals to provide an accurate AoA estimation.

Additional objects, advantages, and features of the present invention will become apparent from the following description and appended claims, taken in conjunction with the accompanying drawings.

BRIEF DESCRIPTION OF THE DRAWINGS

FIG. 1 is a top view of a center fed-end fed, multiple arm spiral antenna, according to an embodiment of the invention;

FIG. 2 is a side view of an antenna system including the multiple arms spiral antenna shown in FIG. 1;

FIG. 3 is a cut-away close up view of an end of one of the arms of the multiple arm spiral antenna shown in FIG. 1, including a micro-strip impedance transformer, according to an embodiment of the present invention;

DETAILED DESCRIPTION OF THE PREFERRED EMBODIMENTS

Figure 4:
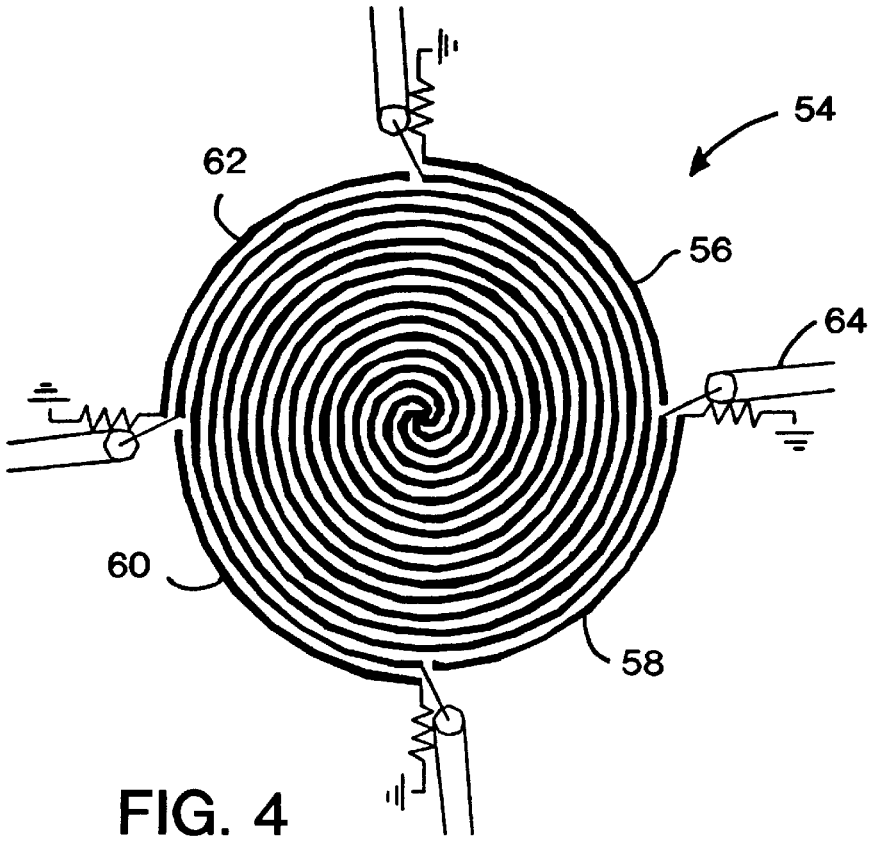
FIG. 4 is a top view of a multiple arm spiral antenna including a co-axial end feed impedance transformer for each arm element, according to another embodiment of the present invention.
Figure 5:
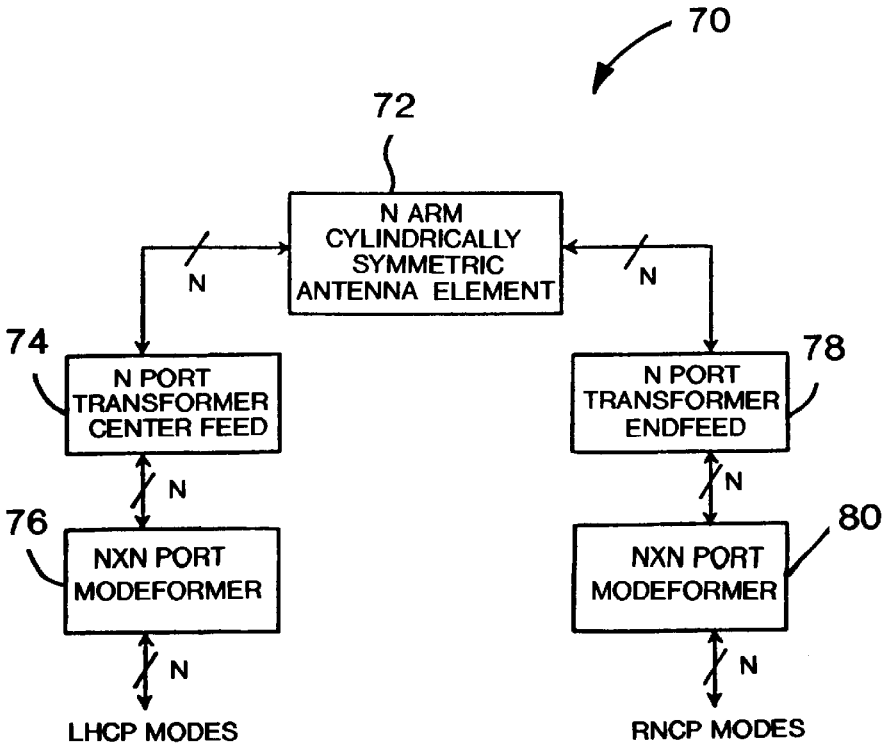
FIG. 5 is a block diagram of a center fed-end fed multiple arm spiral antenna system, according to the invention.

The following discussion of the preferred embodiments directed to an end fed-center fed multiple arm spiral antenna is merely exemplary in nature, and is in no way intended to limit the invention or its applications or uses.

FIG. 1 is a top view of a multi-mode, multiple arm spiral antenna 10, according to an embodiment of the present invention. The antenna 10 includes four arm elements 12, 14, 16 and 18 that spiral out from a common center location 20 in the spiral configuration as shown. Each arm element 12–18 is a narrow piece of a conductive material that does not have sharp impedance discontinuities. The arm elements 12–18 would be formed on a suitable substrate (not shown) by a suitable metal deposition and etching process, as would be well understood to those skilled in the art. Each arm element 12–18 is fed at both an inner end near the center location 20 and an outer end so that the antenna 10 simultaneously is sensitive to both RHCP and LHCP signals. Therefore, each separate arm element 12–18 includes a separate antenna feed at both ends of the element. Twice the number of modes are generated over the prior art multiple arm spiral antennas having the same number of arms and only a center feed. The center feed senses one polarization and the end feed the other sense.

In this example, the antenna elements 12–18 spiral in a counter-clockwise direction. Therefore, the center feed connections provide the LHCP modes and the end feed connections provide the RHCP modes. If the antenna elements spiraled in the opposite direction, then the center feed connections would provide the RHCP modes and the end feed connections would provide the LHCP modes. In alternate designs, the number of arm elements can be increased to provide additional modes for increased AoA estimation sensitivity.

FIG. 2 is a side view of a single aperture antenna system 26 that employs a multiple arm spiral antenna 28 of the type discussed above. The antenna 28 is positioned on a support structure 30 that defines a cavity 32 and a single circular antenna aperture. The antenna 28 and its substrate are mounted on a spacer layer 34 which is mounted on a cavity absorber 36, all within the cavity 32. Each outer end of the arms of the antenna 28 is connected to a separate feed wire 40 that is connected to a separate RF co-axial connector 42 mounted to the structure 30 for feeding the outer ends of the antenna 28. Likewise, each inner end of the arms of the antenna 28 is connected to a separate feed line that extends down through the absorber 36 and is connected to a separate RF co-axial connector 44, also mounted to the structure 30, for feeding the inner ends of the antenna 28. The overall configuration of the antenna system 26 is shown by way of a non-limiting example, in that other configurations for connecting the feeds to the antenna 28 can be employed.

The impedance of the arm elements 12–18 may be 100 Ω and the antenna feed circuitry may be 50 Ω. An impedance matching or compensation network is required to match the receiver impedance to the antenna arm impedance. An end feed transformer-to-aperture transition 48 is employed at each outer end feed connection for impedance matching purposes. An impedance transformer is also beneficial at the center feed connection.

The transition 48 can be any suitable compensating, parasitic metallic winding or strip connected to each arm element 12–18 to compensate for the geometric asymmetry that reduces impedance mismatch and cross-polarization radiation interaction. These windings or strips can be strip-line transformers formed along the wall of the cavity 32 for feeding the outside end of each arm element 12–18. Additionally, micro-strip transformers can be provided on the same dielectric substrate at the spiral aperture attached to each arm element 12–18. Co-axial cable transformers forming all or part of a system of impedance transformation attached to each arm element 12–18 can also be used.

In this regard, FIG. 3 shows a blown-up view of the end of the arm element 18 of the antenna 10 that includes a conductive nub 50 as part of the end feed that provides the impedance matching between the arm element 18 and the transmission line 40. The nub 50 is part of an impedance matching strip-line, micro-strip or the like.

In an alternate embodiment, FIG. 4 shows a spiral arm antenna 54 similar to the antenna 10, and including four arm elements 56, 58, 60 and 62. In this embodiment, the impedance matching is provided by four co-axial cables 64 and a resistor 66, where the center conductor of the cables 64 is electrically connected to the particular arm proximate an end location of an adjacent arm, as shown.

FIG. 3 is a block diagram of a center fed-end fed spiral antenna system 70, according to the invention. Box 72 represents an N-arm cylindrically symmetric antenna element, such as the spiral antenna 10 discussed above. The center end of each arm element 12–18 is connected to an N-port center feed transformer 74 that provides impedance matching to an NXN port modeformer 76. Likewise, the outer end of each arm element 12–18 is connected to an N-port end feed transformer 78 that provides the impedance matching to an NXN port end feed modeformer 80. The transformer 78 also provides the cross-polarization compensation discussed above. In an alternate embodiment, a single modeformer can be used to control both the end feed and center feed signals in an alternate matter. In this embodiment, all of the end feeds or center feeds are connected to a single impedance matching network, instead of a separate impedance matching structure.

The NXN modeformers 76 and 80 provide phase weighting for each antenna element signal to separate the various modes received by the antenna elements. The output of each modeformer 76 and 80 is thus a series of outputs for the number of arms of the element 72. Any suitable modeformer, such as a butler matrix modeformer, can be used for modeformers 76 and 80 to separate the various modes generated by the several arms of the antenna element 72. U.S. Pat. No. 5,777,579, issued to Goetz et al., Jul. 7, 1998 titled "Low Cost Butler Matrix Modeformer Circuit" discloses a modeformer suitable for the operation of the modeformers 46 and 50. U.S. patent application Ser. No. 09/181,370, filed Oct. 28, 1998, titled "Low Cost Even numbered Port Modeformer Circuit," assigned to the assignee of this application, also discloses a modeformer suitable for this purpose.

The multiple arm spiral antenna discussed above provides a wideband, single aperture direction finding antenna system that has a low radar cross section and is simultaneously sensitive to both RHCP and LHCP signals. Built in test and calibration/fault-detection/fault isolation signal injection for end-to-end bias error reduction calibration can also be implemented. The antenna system of the invention provides high accuracy and low cost AoA systems; DCP from single CP aperture; 6:1 phase slope for a four-arm CP spiral; 14:1 phase slope for a eight-arm CP spiral; center feed limitations of low order mode—highest frequency of operation is eliminated; and lowest antenna RCS for a dual polarization antenna.

The foregoing discussion discloses and describes merely exemplary embodiments of the present invention. One skilled in the art will readily recognize from discussion, and from the accompanying drawings and claims, that various changes, modifications and variations can be made therein without departing from the spirit and scope of the invention as defined in the following claims.

What is claimed is:

1. An antenna system responsive to both RHCP and LHCP signals, said antenna system comprising:

a multiple arm spiral antenna, said antenna including a plurality of spiral antenna arms spiraling out from a common central location;

a plurality of first antenna feeds, a separate one of the plurality of first antenna feeds being electrically connected to an inner end of each of the antenna arms at the central location;

a plurality of second antenna feeds, a separate one of the plurality of second antenna feeds being electrically connected to each of the antenna arms at an outer end of the antenna arms opposite the central location; and at least one modeformer connected to the first and second antenna feeds, said at least one modeformer separating signals from both the first and second antenna feeds and generating multiple modes of separated RHCP and LHCP signals.

2. The antenna system according to claim 1 wherein the at least one modeformer is two modeformers, one of the modeformers being responsive to the signals from the plurality of first antenna feeds and the other of the modeformers being responsive to the signals from the plurality of second antenna feeds.

3. The antenna system according to claim 2 wherein the two modeformers are NXN port modeformers where N is the number of spiral arms.

4. The antenna system according to claim 1 wherein the plurality of second feeds include an impedance and compensation system for providing impedance matching and cross-polarization compensation between the outer end of each antenna arm and a co-axial connector electrically connected to the outer end of the antenna arm.

5. The antenna system according to claim 4 wherein the impedance matching and compensation system includes conductive members selected from the group consisting of stripline transformers, micro-strip transformers and co-axial cable transformers.

6. The antenna system according to claim 4 wherein the impedance and compensation system includes a transformer formed along a wall of a cavity defining a single aperture of the antenna system.

7. The antenna system according to claim 1 wherein the plurality of first and second antenna feeds include at least one impedance transformer, said at least one impedance transformer providing impedance matching between the antenna and the at least one modeformer.

8. The antenna system according to claim 7 wherein the at least one transformer is a first N-port transformer and a second N-port transformer, where N is the number of antenna arms, said first transformer providing impedance matching for the plurality of first antenna feeds and the second transformer providing impedance matching for the plurality of second antenna feeds.

9. The antenna system according to claim 7 wherein the at least one transformer is selected from the group consisting of metallic winding transformers, coplanar strip transformers, stripline transformers, micro-strip transformers and co-axial cable transformers.

10. The antenna system according to claim 1 wherein each spiral arm has a smooth transition from the central location to the outer end.

11. A center-fed/end-fed antenna system for simultaneously receiving both RHCP and LHCP signals, said antenna system comprising:

a multiple arm spiral antenna, said antenna including a plurality of spiral antenna arms spiraling out from a common central location, where each antenna arm has a smooth transition from an inner end proximate the central location to an outer end;

a plurality of first antenna feeds, a separate one of the plurality of first antenna feeds being electrically connected to the inner end of each of the antenna arms proximate the central location;

a plurality of second antenna feeds, a separate one of the plurality of second antenna feeds being electrically connected to each of the antenna arms at the outer end of the arms opposite the central location; and a first NXN port modeformer and a second NXN port modeformer where N is the number of spiral arms, the first modeformer being responsive to signals from the plurality of first antenna feeds and the second modeformer being responsive to signals from the plurality of second antenna feeds, said first and second modeformers separating the signals from the plurality of first and second antenna feeds to provide separated RHCP and LHCP signals.

12. The antenna system according to claim 11 wherein the plurality of second feeds include an impedance and compensation system for providing impedance matching and cross-polarization compensation between the outer end of each antenna arm and a co-axial connector electrically connected to the outer end of the antenna arm.

13. The antenna system according to claim 12 wherein the impedance matching and compensation system includes conductive members selected from the group consisting of stripline transformers, micro-strip transformers and co-axial cable transformers.

14. The antenna system according to claim 12 wherein the impedance and compensation system includes a transformer formed along a wall of a cavity defining a single aperture of the antenna system.

15. The antenna system according to claim 11 further comprising an impedance matching network that provides impedance matching between the plurality of first antenna feeds and the first modeformer and provides impedance matching between the plurality of second antenna feeds and the second modeformer.

16. A method of sensing both RHCP and LHCP signals using an antenna including a plurality of spiral antenna arms spiraling out from a common center location, said method comprising the steps of:

connecting a center feed to an inner end of each of the spiral arms at the center location;

sensing one of either the RHCP or LHCP signals by the center feeds;

connecting an end feed to an outer end of each of the spiral arms opposite the center location; and sensing the other of the RHCP or LHCP signals by the end feeds.

17. The method according to claim 16 further comprising the steps of applying center fed signals from the center feeds to a first modeformer and applying end fed signals from the end feeds to a second modeformer.

18. The method according to claim 16 further comprising the steps of providing impedance matching between the center feeds and the first modeformer and providing impedance matching between the end feeds and the second modeformer.

19. The method according to claim 16 further comprising the step of providing impedance matching and cross-polarization compensation between each of the end feeds and a co-axial cable.

20. The method according to claim 19 wherein the step of providing impedance matching and cross-polarization compensation includes using a transformer selected from the group consisting of metallic windings, coplanar strips, striplines micro-strips and co-axial cables.

* * * * *